US005353845A

United States Patent [19]

Corain et al.

[11] Patent Number: 5,353,845

[45] Date of Patent: Oct. 11, 1994

[54] RAPID RELEASE SYSTEM FOR FALSE SELVEDGE AND FABRIC EDGE BINDING MEMBERS

[75] Inventors: Luciano Corain; Gianni Maitan, both of Venice, Italy

[73] Assignee: Nuovopignone-Industrie Mecaniche e Fonderia SpA, Florence, Italy

[21] Appl. No.: 55,208

[22] Filed: Jan. 29, 1993

[30] Foreign Application Priority Data

May 5, 1992 [IT] Italy ..... MI92 A 001072

[51] Int. Cl.[5] ..... D03D 47/40

[52] U.S. Cl. ..... 139/54; 28/208; 139/91; 139/430; 139/194; 139/192

[58] Field of Search ..... 139/54, 430, 433, 434, 139/194, 192, 91, 1 R; 28/208

[56] References Cited

U.S. PATENT DOCUMENTS 4,614,210 9/1986 Debaes ..... 139/54

4,934,413 6/1990 Yao ..... 139/1 R

FOREIGN PATENT DOCUMENTS 0493847 7/1992 European Pat. Off. ..... 139/194

610604 4/1979 Switzerland .

2129449 5/1984 United Kingdom .

*Primary Examiner*—Andrew M. Falik

*Attorney, Agent, or Firm*—Morgan & Finnegan

[57] ABSTRACT

A shuttleless loom in which that part of the reed traversed, by the false selvedge yarns and the binding yarns for the side edges of the fabric under formation is detached from the rest of the reed. The detached part is made easily removable from the loom sley, whereas the grids of the false selvedge formation device and of the binding device are mounted on two rigid frameworks. These frameworks are easily removed through a quick-break connection from their supports, these being driven with opposing reciprocating movement within guides fixed to the loom.

1 Claim, 2 Drawing Sheets

RAPID RELEASE SYSTEM FOR FALSE SELVEDGE AND FABRIC EDGE BINDING MEMBERS

BACKGROUND OF THE INVENTION

1. Field Of The Invention

This invention relates to improvements in shuttleless looms and more precisely relates to a rapid release system for the false selvedge and fabric edge binding members which, by enabling the heddle frames to be replaced without the need to cut and then rethread the false selvedge and side binding yarns when changing the article to be woven, results in a considerable reduction in down-time with consequent increase in loom productivity.

2. Description Of The Prior Art

As is well known from the state of the art, during fabric formation it is necessary to use false selvedge yarns for maintaining the inserted weft yarns under tension, and also binding yarns for the fabric side edges.

Whereas said binding yarns are always supplied by bobbins independent of the warp yarn feed beam, the false selvedge yarns can be fed from said beam if of the same type as the warp yarns, but in modern shuttleless looms said false selvedge yarns are also preferably fed from bobbins independent of the beam in order to be able to tension them differently from the warp yarn or to be able to use yarns of lesser quality and hence lesser cost than the warp yarn.

All said binding yarns and false selvedge yarns which are fed independently of the warp beam and moved by relative independent selvedge and binding formation devices fixed on the loom, are compelled to pass; through the loom frames, through the grids of said independent devices and through the loom reed teeth respectively, before reaching the edge of the fabric under formation.

It will therefore be apparent that if the article to be woven is to be changed, consequently making it necessary to change the warp beam, the warp heddle frames and the reed, all said binding and false selvedge yarns have to be withdrawn from the reed teeth, from the grids of the relative independent devices and from the heddle frames in order to release these and enable them to be removed from the loom. When the requirements for the new article to be woven are in place, said yarns have all to be rethreaded, with a consequent considerable time wastage together with the possibility of threading errors, resulting in a loss of productivity of the loom.

SUMMARY OF THE INVENTION

The object of the present invention is to obviate said drawback by providing a system which allows change of the article to be woven, i.e. replacement of the warp beam, heddle frames and reed, without the need for rethreading the false selvedge and binding yarns. This is substantially achieved in that that part of the reed concerned with said yarns is now detached from the rest of the reed and is made easily removable from the loom sley, whereas the grids of the false selvedge device and of the binding device for the fabric side edges are mounted on two rigid frameworks which themselves are easily removed from their supports, these being driven with opposing reciprocating movement within guides fixed to the loom.

In this manner, it is necessary merely to demount said reed part and said frameworks while maintaining the false selvedge and binding yarns always threaded through them, and withdraw the entire system through the heddle frames to render these latter free for replacement together with the reed and the warp beam, after which, by again passing the entire system comprising the frameworks and reed part through the new heddle frames with the same yarns inserted, and then fixing said system in position, weaving can recommence.

Hence the shuttleless loom, comprising a warp yarn feed beam, heddle frames through the eyes of which said warp yarns pass, feed bobbins for the false selvedge yarns and binding yarns for the side edges of the fabric under formation, these yarns connecting to the edge of said fabric by passing through said heddle frames, through the eyes in the grids of the false selvedge forming device and of the binding device, and through corresponding teeth of a reed mounted on a sley, through which teeth there also pass said warp yarns, and further comprising two grid supports which are driven vertically with opposing reciprocating movement within guides fixed to the loom, is characterised according to the present invention in that that part of the reed traversed by said false selvedge yarns and said yarns for the fabric side edges is made independent of the rest of the reed and easily removable from said sley, said grids of the false selvedge formation device and of the binding device being mounted on two rigid frameworks which are themselves easily removable via a quick-break connection on said two supports.

The invention is described in detail hereinafter with reference to the accompanying drawings, which shown a preferred embodiment thereof by way of example only, in that technical or constructional modifications can be made thereto but without leaving the scope of the present invention.

DESCRIPTION OF THE PREFERRED EMBODIMENT(S)

Figure 1:
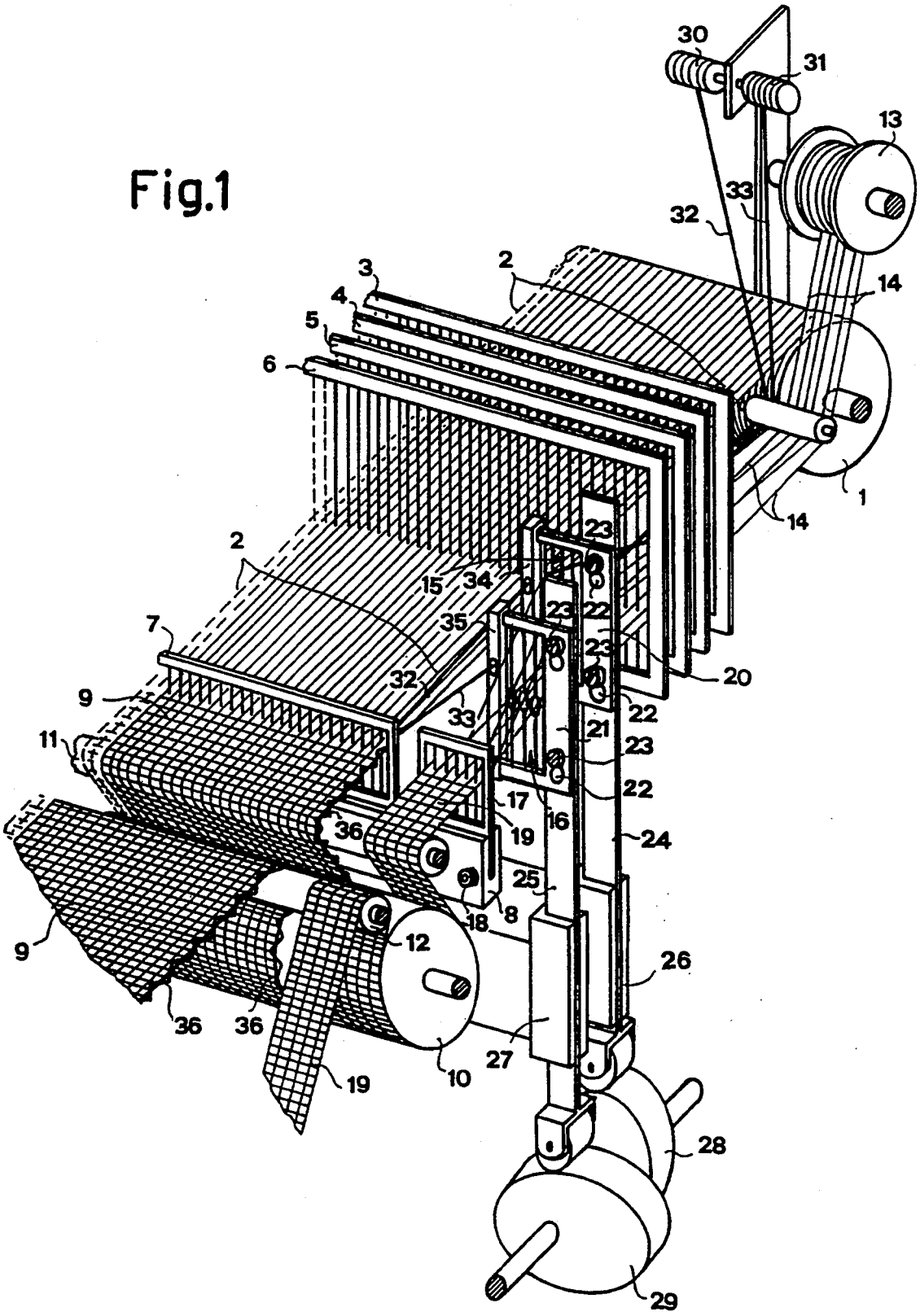
FIG. 1 is a partly sectional partial perspective view of the right end of a shuttleless loom using the system for rapid release of the fabric false selvedge and edge binding formation members according to the invention.
Figure 2:
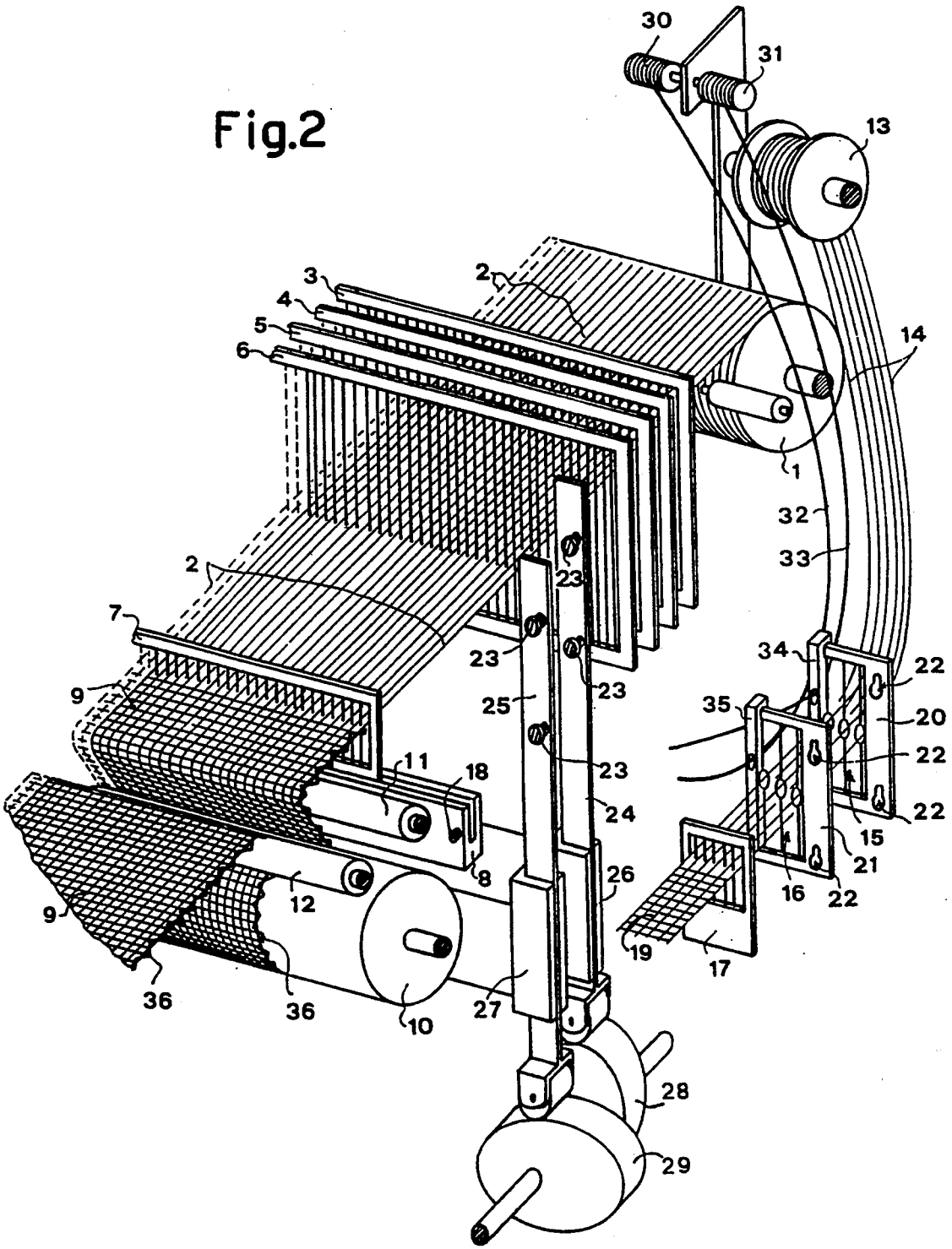
FIG. 2 is a view analogous to FIG. 1 showing said false selvedge and edge binding formation members released and withdrawn from the loom heddle frames.

In the figures the reference numeral 1 indicates the feed beam for the warp yarns 2 which, after passing through heddle eyes in the heddle frames 3, 4, 5 and 6, and through corresponding teeth in the reed 7 mounted on the sley 8, form the fabric 9 which, dragged by the fabric drawing roller 10 and guided by the deviation rollers 11 and 12, is wound on a beam not shown in the figures.

A bobbin 13 feeds the false selvedge yarns 14 which pass through said heddle frames 3, 4, 5 and 6, through the eyes of the grids 15 and 16 and then through corresponding teeth of a reed part 17 removably mounted in the groove in said sley 8 and fixed thereto by a least one pressing screw 18, to form the false selvedge 19. Said grids 15 and 16 are also mounted respectively on two rigid frameworks 20 and 21 which are themselves mounted, in a manner easily removable by virtue of the quick-break connection provided by slots 22 in said frameworks in cooperation with screws 23, on two supports 24 and 25 which are driven vertically with opposing reciprocating movement by operating cams 28 and 29 and guided within guides 26 and 27 fixed to the loom.

Finally, two further independent bobbins 30 and 31 feed the two yarns 32 and 33 which pass through said heddle frames 3, 4, 5 and 6, through respectively the grids 34 and 35 of the binding device, these also being mounted on said rigid frameworks 20 and 21 respectively, and then through the last tooth on the right of said reed 7, to form the binding 36 for the right edge of the fabric 9. The method of operation in such a loom when the article to be woven is to be changed is now apparent.

After cutting the false selvedge 19 and the two binding yarns 32 and 33, the reed part 17 and the rigid frameworks 20 and 21 are released by slackening the screw 18 and the screws 23, the entire system then being withdrawn through the heddle frames 6, 5, 4 and 3 so that the beam 2, the heddle frames 3, 4, 5 and 6 and the reed 7 can be replaced without the need to unthread and then rethread the false selvedge yarns 14 and binding yarns 32 and 33.

What is claimed is:

1. A shuttleless loom for producing a fabric that has side edges from false selvedge yarns and binding yards, comprising a warp yarn feed beam, heddle eyes through which the warp yarns pass, grids having grid eyes through which the false selvedge yarns pass, feed bobbins for the false selvedge yarns and binding yarns for the side edges of the fabric under formation, these yarns connecting to the edge of the fabric by passing through said heddle eyes and through said eyes in the grids, and through corresponding teeth of a reed mounted on a sley, through which teeth there also pass the warp yarns, two movable grid supports which move linearally with opposing reciprocating movement, guides fixed to the loom for establishing said linear movement, said reed having a part that is traversed by the false selvedge yarns and the yarns for the fabric side edges, means for releasably attaching said reed to said sley, said grids being mounted on two rigid frameworks, and quick-break connection means on said two supports for selectively removing said grids therefrom.

* * * * *

UNITED STATES PATENT AND TRADEMARK OFFICE

CERTIFICATE OF CORRECTION

PATENT NO. : 5,353,845

DATED : October 11, 1994

INVENTOR(S) : Luciano Corain et al.

It is certified that error appears in the above-identified patent and that said Letters Patent is hereby corrected as shown below:

Title page, item : [22], delete "January" and substitute -- April --.

Signed and Sealed this

Twenty-second Day of August, 1995

*Attest:*

BRUCE LEHMAN

*Attesting Officer*

*Commissioner of Patents and Trademarks*